US012774668B2

(12) United States Patent
Honjo et al.

(10) Patent No.: US 12,774,668 B2
(45) Date of Patent: Oct. 27, 2026

(54) EXHAUST GAS TREATMENT SYSTEM, ABSORBING LIQUID MANAGEMENT APPARATUS, AND TREATMENT METHOD OF EXHAUST GAS

(71) Applicant: MITSUBISHI HEAVY INDUSTRIES, LTD., Tokyo (JP)

(72) Inventors: Shintaro Honjo, Tokyo (JP); Takashi Kamijo, Tokyo (JP); Osamu Miyamoto, Tokyo (JP); Hiroshi Tanaka, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 331 days.

(21) Appl. No.: 18/738,242

(22) Filed: Jun. 10, 2024

(65) Prior Publication Data

US 2025/0376935 A1 Dec. 11, 2025

(51) Int. Cl.
*B01D 53/02* (2006.01)
*F01N 3/04* (2006.01)
*F01N 3/08* (2006.01)

(52) U.S. Cl.
CPC ..... *F01N 3/0857* (2013.01); *F01N 3/04* (2013.01); *F01N 3/0885* (2013.01); *F01N 2370/00* (2013.01); *F01N 2570/10* (2013.01)

(58) Field of Classification Search
CPC .... F01N 2370/00; F01N 2570/10; F01N 3/04; F01N 3/0857; F01N 3/0885; Y02C 20/40
See application file for complete search history.

(56) References Cited

U.S. PATENT DOCUMENTS

2014/0127102 A1* 5/2014 Okuno ..... B01D 53/62 422/106
2019/0126235 A1* 5/2019 Okumura ..... B01J 20/3231
2020/0155996 A1* 5/2020 Okamoto ..... B01J 45/00
2021/0299609 A1* 9/2021 Matake ..... H01M 8/0662

FOREIGN PATENT DOCUMENTS

JP 3968457 B2 8/2007
JP 2023-148274 A 10/2023

* cited by examiner

*Primary Examiner* — Christopher P Jones
(74) *Attorney, Agent, or Firm* — Osha Bergman Watanabe & Burton LLP

(57) ABSTRACT

In an exhaust gas treatment system, a cooling tower cools an exhaust gas containing carbon dioxide. In an absorption tower, an amine-based absorbing liquid capable of absorbing the carbon dioxide in the exhaust gas is introduced and the carbon dioxide in the exhaust gas passing through the cooling tower is absorbed by the amine-based absorbing liquid. A regeneration tower heats the amine-based absorbing liquid absorbing the carbon dioxide, separates the carbon dioxide from the amine-based absorbing liquid, and regenerates the amine-based absorbing liquid. An addition unit adds an additive for adjusting a hydroxide ion concentration of the cooling liquid to the cooling liquid. A state detection unit detects a state of the amine-based absorbing liquid. A control apparatus adjusts an amount of addition of the additive in the addition unit based on a state of the amine-based absorbing liquid detected by the state detection unit.

13 Claims, 7 Drawing Sheets

EXHAUST GAS TREATMENT SYSTEM, ABSORBING LIQUID MANAGEMENT APPARATUS, AND TREATMENT METHOD OF EXHAUST GAS

BACKGROUND OF THE INVENTION

Field of the Invention

The present disclosure relates to an exhaust gas treatment system, an absorbing liquid management apparatus, and an exhaust gas treatment method.

Description of Related Art

It is desirable to reduce an amount of emission of carbon dioxide contained in exhaust gas from watercrafts and plants such as power plants. For this reason, for example, Patent Document 1 discloses a configuration of a carbon dioxide separation and capture system for capturing carbon dioxide contained in exhaust gas by bringing the exhaust gas into contact with an amine-based absorbing liquid. In this configuration, the amine-based absorbing liquid is replaced on the basis of the electrical conductivity and oxidation-reduction potential of the amine-based absorbing liquid whose absorption performance deteriorates with use.

PATENT DOCUMENTS

[Patent Document 1] Japanese Unexamined Patent Application, First Publication No. 2023-148274

SUMMARY OF THE INVENTION

However, aldehydes are generated when the amine-based absorbing liquid is oxidized by reacting with oxygen ($O_2$) contained in exhaust gas in an absorption tower. It is not desirable for the generated aldehydes to be discharged into the atmosphere from the absorption tower.

On the other hand, when oxidative deterioration of the amine-based absorbing liquid occurs, the amine-based absorbing liquid can be replaced according to the configuration disclosed in Patent Document 1, but replacing the amine-based absorbing liquid requires labor and cost.

The present disclosure has been made to solve the above problems and an objective of the present disclosure is to provide an exhaust gas treatment system, an absorbing liquid management apparatus, and an exhaust gas treatment method for enabling oxidative deterioration of an absorbing liquid to be effectively suppressed while minimizing labor and cost.

In order to achieve the above-described objective, according to the present disclosure, there is provided an exhaust gas treatment system including: a cooling tower configured to cool exhaust gas by bringing the exhaust gas containing carbon dioxide into contact with a cooling liquid; an absorption tower in which an amine-based absorbing liquid capable of absorbing the carbon dioxide in the exhaust gas is introduced and the carbon dioxide in the exhaust gas passing through the cooling tower is absorbed by the amine-based absorbing liquid; a regeneration tower configured to heat the amine-based absorbing liquid absorbing the carbon dioxide, separate the carbon dioxide from the amine-based absorbing liquid, and regenerate the amine-based absorbing liquid; an addition unit configured to add an additive for adjusting a hydroxide ion concentration of the cooling liquid to the cooling liquid; a state detection unit configured to detect a state of the amine-based absorbing liquid; and a control apparatus configured to adjust an amount of addition of the additive in the addition unit on the basis of a state of the amine-based absorbing liquid detected by the state detection unit.

According to the present disclosure, there is provided an absorbing liquid management apparatus provided in an exhaust gas treatment system including a cooling tower configured to cool exhaust gas by bringing the exhaust gas containing carbon dioxide into contact with a cooling liquid, an absorption tower in which an amine-based absorbing liquid capable of absorbing the carbon dioxide in the exhaust gas is introduced and the carbon dioxide in the exhaust gas passing through the cooling tower is absorbed by the amine-based absorbing liquid, and a regeneration tower configured to heat the amine-based absorbing liquid absorbing the carbon dioxide, separate the carbon dioxide from the amine-based absorbing liquid, and regenerate the amine-based absorbing liquid, the absorbing liquid management apparatus including: an addition unit configured to add an additive for adjusting a hydroxide ion concentration of the cooling liquid to the cooling liquid; a state detection unit configured to detect a state of the amine-based absorbing liquid; and a control apparatus configured to adjust an amount of addition of the additive in the addition unit on the basis of a state of the amine-based absorbing liquid detected by the state detection unit.

According to the present disclosure, there is provided an absorbing liquid treatment method of cooling exhaust gas by bringing the exhaust gas containing carbon dioxide into contact with a cooling liquid, causing the carbon dioxide in the exhaust gas to be absorbed by an amine-based absorbing liquid capable of absorbing the carbon dioxide in the exhaust gas, heating the amine-based absorbing liquid absorbing the carbon dioxide, separating the carbon dioxide from the amine-based absorbing liquid, and regenerating the amine-based absorbing liquid, the absorbing liquid treatment method including steps of: detecting a state of the amine-based absorbing liquid; and adjusting an amount of addition of the additive for adjusting a hydroxide ion concentration of the cooling liquid for the cooling liquid on the basis of the detected state of the amine-based absorbing liquid.

According to the exhaust gas treatment system, the absorbing liquid management apparatus, and the exhaust gas treatment method of the present disclosure, it is possible to effectively suppress oxidative deterioration of absorbing liquid while minimizing labor and cost.

DETAILED DESCRIPTION OF THE INVENTION

Hereinafter, embodiments of an exhaust gas treatment system, an absorbing liquid management apparatus, and an exhaust gas treatment method according to the present disclosure will be described with reference to the accompanying drawings. However, the present disclosure is not limited to these embodiments.

First Embodiment (Configuration of Exhaust Gas Treatment System)

Figure 1:
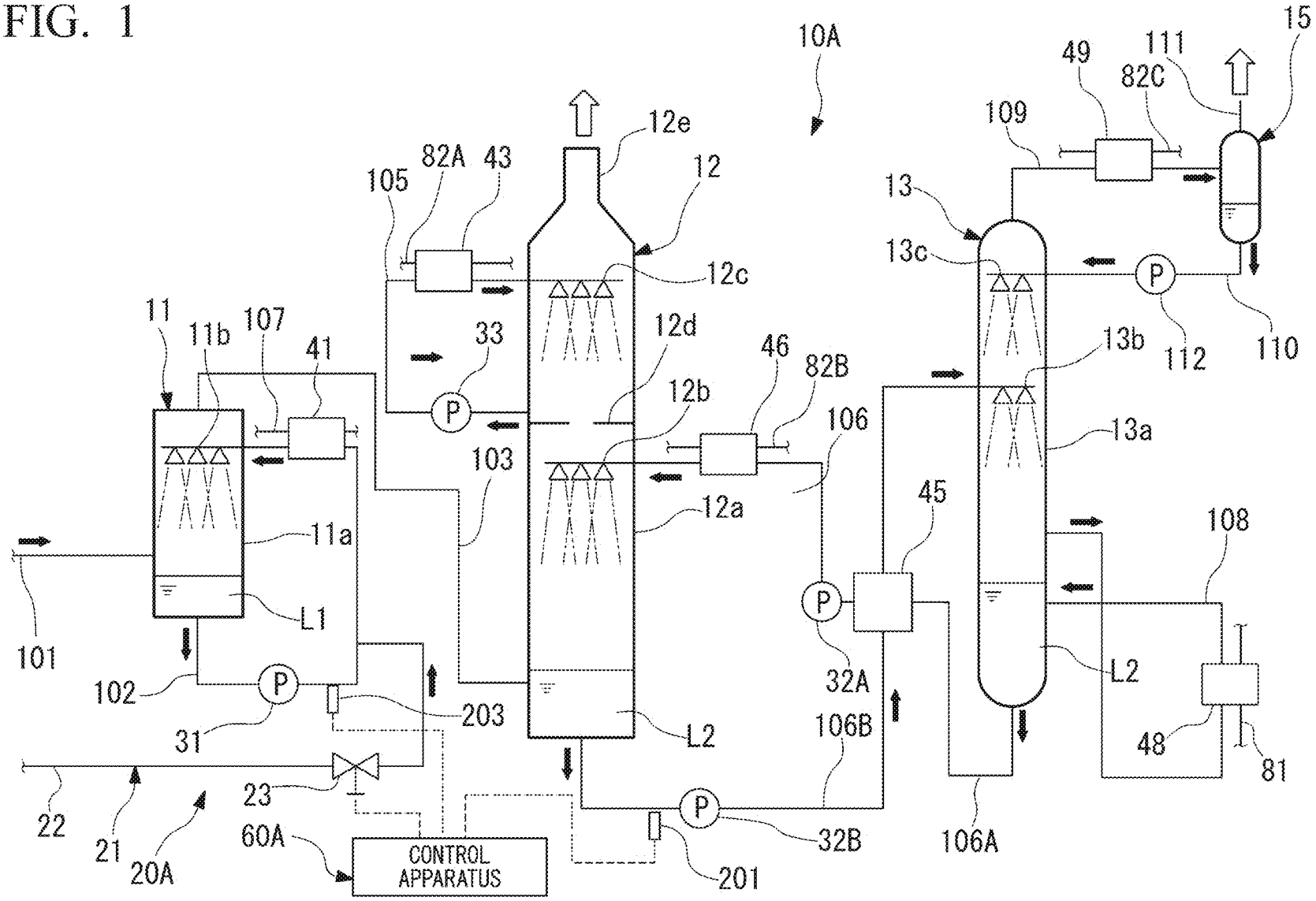
FIG. 1 is a diagram showing a configuration of an exhaust gas treatment system according to a first embodiment of the present disclosure.

An exhaust gas treatment system 10A shown in FIG. 1, for example, is connected to a gas emission source (not shown) that emits exhaust gas containing carbon dioxide provided in watercrafts and plants such as power plants. Specifically, in the case of a watercraft, the gas emission source is, for example, an internal combustion engine used for a main engine for propelling the watercraft, an internal combustion engine used for a power generation facility that supplies electricity into the watercraft, a boiler for generating steam, and the like. In the case of a power plant, the gas emission source is a blast furnace. In this gas emission source, the exhaust gas generated by burning fuel contains carbon dioxide and a sulfur component such as sulfur dioxide ($SO_2$).

The exhaust gas treatment system 10A captures carbon dioxide contained in the exhaust gas from the gas emission source. The exhaust gas treatment system 10A includes a cooling tower 11, an absorption tower 12, a regeneration tower 13, a capture unit 15, and an absorbing liquid management apparatus 20A.

The cooling tower 11 cools the exhaust gas from the gas emission source with a cooling liquid L1. When the gas emission source is provided in the watercraft, water around the watercraft or fresh water stored in a freshwater tank (not shown) provided in the watercraft can be used as the cooling liquid L1. When the gas emission source is provided in a plant such as a power plant, for example, seawater, river water, industrial water, or the like can be used as the cooling liquid L1.

One end of a gas introduction line 101 is connected to a lower portion of the cooling tower 11. The gas introduction line 101 is provided at an inlet of the exhaust gas treatment system 10A and the exhaust gas is injected from an external gas exhaust source (not shown) of the exhaust gas treatment system 10A. The other end of the gas introduction line 101 is connected to a desulfurization apparatus (not shown) provided between the gas emission source and the cooling tower 11. The desulfurization apparatus removes a sulfur component such as sulfur dioxide ($SO_2$) contained in the exhaust gas.

The cooling tower 11 includes a tower body 11*a* and a nozzle 11*b* configured to spray the cooling liquid L1 from the upper portion of the tower body 11*a*. A cooling liquid supply line 102 configured to circulate the cooling liquid L1 is connected to the cooling tower 11. One end of the cooling liquid supply line 102 is connected to a bottom portion of the tower body 11*a*. The other end of the cooling liquid supply line 102 is connected to the nozzle 11*b* at an upper portion of the tower body 11*a*.

In the middle of the cooling liquid supply line 102, a cooling liquid supply pump 31 and a first heat exchanger 41 are provided. The cooling liquid supply pump 31 sucks out the cooling liquid L1 accumulated at the bottom portion of the tower body 11*a* from the inside of the tower body 11*a* and supplies the cooling liquid L1 to the nozzle 11*b* at the upper portion of the tower body 11*a*. The cooling liquid L1 supplied to the nozzle 11*b* is sprayed from the nozzle 11*b* into the tower body 11*a* and comes into contact with the exhaust gas sent into the tower body 11*a* (gas-liquid contact). Thereby, the exhaust gas is cooled and soot dust and the like contained in the exhaust gas are captured by the cooling liquid L1 and washed away.

The first heat exchanger 41 cools the cooling liquid L1 by exchanging heat between the cooling liquid L1 coming into the cooling liquid supply line 102 and the cooling water coming into the refrigerant line 107.

One end of the exhaust gas discharge line 103 is connected to the top of the tower body 11*a*. The exhaust gas discharge line 103 sends exhaust gas cooled by washing soot dust or the like with a cooling liquid in the tower body 11*a* to the absorption tower 12.

The absorption tower 12 causes carbon dioxide contained in the exhaust gas to be absorbed by an amine-based absorbing liquid L2 containing amines. The absorption tower 12 includes a tower body 12*a* and nozzles 12*b*, and 12*c*. The nozzle 12*b* removes carbon dioxide from the exhaust gas by spraying the absorbing liquid L2 into the tower body 12*a* and applying the exhaust gas to a gas-liquid contact process. The nozzle 12*c* sprays cleaning water into the tower body 12*a* and brings it into contact with the exhaust gas from which carbon dioxide has been removed and which rises inside the tower body 12*a*, thereby capturing the absorbing liquid L2 contained in the exhaust gas and sprayed from the nozzle 12*b*. The other end of the exhaust gas discharge line 103 is connected to the lower portion of the tower body 12*a*. The exhaust gas passing through the cooling tower 11 is sent into the tower body 12*a* through the exhaust gas discharge line 103.

The nozzle 12*b* is provided at the lower portion of the absorption tower 12. The nozzle 12*c* is provided at the upper portion of the absorption tower 12. The amine-based absorbing liquid L2 is supplied from the regeneration tower 13 to the nozzle 12*b* via a circulation line 106 to be described below.

A cleaning water circulation line 105 configured to circulate cleaning water is connected to the absorption tower 12. One end of the cleaning water circulation line 105 is connected to an intermediate portion of the tower body 12*a*. The other end of the cleaning water circulation line 105 is connected to the nozzle 12*c* in the tower body 12*a* at the upper portion of the tower body 12*a*. In the middle of the cleaning water circulation line 105, a cleaning water circulation pump 33 and a second heat exchanger 43 are provided. The cleaning water circulation pump 33 sucks out the cleaning water from a cleaning water receiver 12*d* provided in the intermediate portion of the tower body 12*a* and supplies the cleaning water to the nozzle 12*c* at the upper portion of the tower body 12*a*.

The amine-based absorbing liquid L2 supplied to the nozzle 12*b* is sprayed into the tower body 12*a* and comes into contact with the exhaust gas sent into the tower body 12*a*. Thereby, the carbon dioxide contained in the exhaust gas is absorbed by the amine-based absorbing liquid L2 in the tower body 12*a* of the absorption tower 12.

A cooling water supply pipe 82A is connected to the second heat exchanger 43. The cooling water supply pipe 82A supplies cooling water from the outside of the exhaust gas treatment system 10A to the second heat exchanger 43. The second heat exchanger 43 exchanges heat between the cooling water supplied from the outside of the exhaust gas treatment system 10A and the cleaning water coming into the cleaning water circulation line 105. In other words, the second heat exchanger 43 cools the cleaning water circulating in the cleaning water circulation line 105 with cooling water supplied from the outside of the exhaust gas treatment system 10A. The cleaning water cooled by the second heat exchanger 43 is sprayed from the nozzle 12*c* at the upper portion of the tower body 12*a* into the tower body 12*a*.

One end of the exhaust pipe 12*e* is connected to the top of the tower body 12*a*. The exhaust pipe 12*e* guides the exhaust gas exiting the absorption tower 12, in other words, the exhaust gas from which the amine-based absorbing liquid L2 has been removed by the absorption tower 12, for example, to an exhaust funnel (not shown) or the like, and discharge the exhaust gas into the atmosphere.

The regeneration tower 13 separates gaseous carbon dioxide from the amine-based absorbing liquid L2 obtained by absorbing carbon dioxide in the absorption tower 12. The regeneration tower 13 includes a tower body 13*a*, a nozzle 13*b* for spraying the amine-based absorbing liquid L2 into the tower body 13*a*, and a nozzle 13*c* for spraying refluxed condensate water. The nozzle 13*b* is provided at the lower portion of the tower body 13*a*. The nozzle 13*c* is provided at the upper portion of the tower body 13*a*.

The circulation line 106 is provided between the absorption tower 12 and the regeneration tower 13. The circulation line 106 circulates the amine-based absorbing liquid L2 between the absorption tower 12 and the regeneration tower 13. The circulation line 106 includes an absorbing liquid supply line 106A, an absorbing liquid discharge line 106B, and a heat exchanger 45.

One end of the absorbing liquid supply line 106A is connected to a bottom portion of the tower body 13*a* of the regeneration tower 13. The other end of the absorbing liquid supply line 106A is connected to the nozzle 12*b* in the tower body 12*a* of the absorption tower 12. In the middle of the absorbing liquid supply line 106A, a first circulation pump 32A and a third heat exchanger 46 are provided. The first circulation pump 32A sucks out the amine-based absorbing liquid L2 from the bottom portion of the tower body 13*a* of the regeneration tower 13 through the absorbing liquid supply line 106A and supplies the amine-based absorbing liquid L2 to the nozzle 12*b* of the tower body 12*a* of the absorption tower 12.

The cooling water supply pipe 82B is connected to the third heat exchanger 46. In the third heat exchanger 46, cooling water is supplied from the outside of the exhaust gas treatment system 10A through the cooling water supply pipe 82B. The third heat exchanger 46 exchanges heat between the cooling water supplied from the outside of the exhaust gas treatment system 10A and the amine-based absorbing liquid L2 coming into the absorbing liquid supply line 106A. In other words, the third heat exchanger 46 cools the amine-based absorbing liquid L2 supplied to the absorption tower 12 through the absorbing liquid supply line 106A with cooling water supplied from the outside of the exhaust gas treatment system 10A. The amine-based absorbing liquid L2 cooled by the third heat exchanger 46 is sprayed from the nozzle 12*b* of the absorption tower 12 into the tower body 12*a*.

One end of the absorbing liquid discharge line 106B is connected to the bottom portion of the tower body 12*a* of the absorption tower 12. The other end of the absorbing liquid discharge line 106B is connected to the nozzle 13*b* provided in the tower body 13*a* of the regeneration tower 13. The second circulation pump 32B is provided in the middle of the absorbing liquid discharge line 106B. The second circulation pump 32B sucks out the amine-based absorbing liquid L2 from the bottom portion of the tower body 12*a* of the absorption tower 12 through the absorbing liquid discharge line 106B, and supplies the amine-based absorbing liquid L2 to the nozzle 13*b* of the tower body 13*a* of the regeneration tower 13.

The heat exchanger 45 exchanges heat between the amine-based absorbing liquid L2 coming into the absorbing liquid supply line 106A and the amine-based absorbing liquid L2 coming into the absorbing liquid discharge line 106B. In other words, the amine-based absorbing liquid L2 obtained by absorbing carbon dioxide before the introduction into the regeneration tower 13 is heated by the heat of the amine-based absorbing liquid L2 immediately after separating carbon dioxide with the regeneration tower 13.

The regeneration tower 13 separates gaseous carbon dioxide from the amine-based absorbing liquid L2 obtained by absorbing carbon dioxide in the absorption tower 12. For this reason, the regeneration tower 13 heats the amine-based absorbing liquid L2 sent into the regeneration tower 13 from the absorption tower 12 via the absorbing liquid discharge line 106B with the absorbing liquid heating line 108.

The absorbing liquid heating line 108 is connected to the regeneration tower 13. The absorbing liquid heating line 108 circulates the amine-based absorbing liquid L2 between the regeneration tower 13 and a reboiler 48. That is, the absorbing liquid heating line 108 supplies the amine-based absorbing liquid L2 extracted from the regeneration tower 13 to the reboiler 48 and returns the amine-based absorbing liquid L2 from the reboiler 48 to the regeneration tower 13. In other words, the reboiler 48 is provided in the middle of the absorbing liquid heating line 108.

The steam supply pipe 81 is connected to the reboiler 48. Steam supplied from a boiler (not shown) provided outside of the exhaust gas treatment system 10A or the like is fed to the reboiler 48 through the steam supply pipe 81. The reboiler 48 exchanges heat between the steam sent through the steam supply pipe 81 and the amine-based absorbing liquid L2 coming into the absorbing liquid heating line 108. That is, the reboiler 48 heats the amine-based absorbing liquid L2 with the heat of the steam.

The reboiler 48 separates gaseous carbon dioxide from the amine-based absorbing liquid L2 by heating the amine-based absorbing liquid L2. The amine-based absorbing liquid L2 and the gaseous carbon dioxide separated by the reboiler 48 are returned into the tower body 13*a* through the absorbing liquid heating line 108. In this way, the amine-based absorbing liquid L2 obtained by separating and regenerating the gaseous carbon dioxide is returned to the absorption tower 12 through the absorbing liquid supply line 106A and reused. On the other hand, the separated gaseous carbon dioxide is sent to the capture unit 15 through the gaseous carbon dioxide discharge line 109.

A condenser 49 is provided in the middle of the gaseous carbon dioxide discharge line 109. A cooling water supply pipe 82C is connected to the condenser 49. Cooling water is supplied from the outside of the exhaust gas treatment system 10A to the condenser 49 through the cooling water supply pipe 82C. The condenser 49 condenses moisture contained in the gaseous carbon dioxide through heat exchange with the cooling water supplied from the outside of the exhaust gas treatment system 10A.

The capture unit 15 captures the gaseous carbon dioxide separated by the regeneration tower 13. The capture unit 15 is a gas-liquid separator and separates gaseous carbon dioxide sent through the condenser 49 and condensate water condensed with moisture.

The gas-liquid separated condensate water is refluxed from the bottom portion of the capture unit 15 to the regeneration tower 13 through the reflux line 110. In the middle of the reflux line 110, a reflux pump 112 for refluxing condensate water to the regeneration tower 13 is provided. The reflux line 110 is connected to the nozzle 13*c* provided at the upper portion of the regeneration tower 13. As the amine-based absorbing liquid L2, the condensate water refluxed to the regeneration tower 13 is sprayed from the nozzle 13*c* of the regeneration tower 13 into the tower body 13*a*.

On the other hand, the gaseous carbon dioxide from which moisture is removed by the capture unit 15 is discharged to the outside of the exhaust gas treatment system 10A through the carbon dioxide discharge pipe 111. The gaseous carbon dioxide discharged through the carbon dioxide discharge pipe 111 is stored, for example, in a carbon dioxide capture tank (not shown). At this time, the gaseous carbon dioxide may be liquefied by an appropriate carbon dioxide liquefaction apparatus and stored in the carbon dioxide capture tank.

In the exhaust gas treatment system 10A as described above, the exhaust gas discharged from the gas emission source (not shown) is washed off by the cooling tower 11 and then introduced into the absorption tower 12. In the absorption tower 12, carbon dioxide contained in the exhaust gas is absorbed by the amine-based absorbing liquid L2. When carbon dioxide is absorbed by the amine-based absorbing liquid L2, the exhaust gas from which carbon dioxide is separated is released into the atmosphere. Moreover, in the absorption tower 12, the amine-based absorbing liquid L2 obtained by absorbing carbon dioxide contained in the exhaust gas is sent to the regeneration tower 13 via the circulation line 106. The amine-based absorbing liquid L2 obtained by absorbing carbon dioxide is heated by the reboiler 48, the temperature rises, and the gaseous carbon dioxide contained in the amine-based absorbing liquid L2 is separated. The separated gaseous carbon dioxide is captured through the capture unit 15. On the other hand, the amine-based absorbing liquid L2 from which carbon dioxide is separated in the regeneration tower 13 circulates through the absorption tower 12 via the circulation line 106.

(Configuration of Absorbing Liquid Management Apparatus)

The absorbing liquid management apparatus 20A manages the amine-based absorbing liquid L2 in the absorption tower 12. The absorbing liquid management apparatus 20A includes an addition unit 21, a state detection unit 201, a pH detection unit 203, and a control apparatus 60A.

The addition unit 21 adds an additive for adjusting a hydroxide ion concentration of the cooling liquid L1 to the cooling liquid L1 of the cooling tower 11. The addition unit 21, for example, adds an alkaline substance such as sodium hydroxide, potassium hydroxide, calcium hydroxide, sodium carbonate, potassium carbonate, calcium carbonate, or magnesium hydroxide as the additive. The additive added to the cooling liquid L1 in the addition unit 21 preferably contains at least one selected from the group of sodium hydroxide, potassium hydroxide, calcium hydroxide, sodium carbonate, potassium carbonate, calcium carbonate, and magnesium hydroxide. In the present embodiment, the addition unit 21 adds sodium hydroxide (NaOH) as an additive, for example, to the cooling liquid L1 of the cooling tower 11. As the additive, a substance other than sodium hydroxide among the substances exemplified above may be used. The addition unit 21 includes an addition line 22 and a flow rate adjustment valve 23.

One end of the addition line 22, for example, is connected between the cooling liquid supply pump 31 and the first heat exchanger 41 in the middle of the cooling liquid supply line 102. The other end of the addition line 22 is connected to a sodium hydroxide supply source (not shown) such as a tank for storing sodium hydroxide. Sodium hydroxide is added from the supply source to the cooling liquid L1, which circulates through the cooling liquid supply line 102, through the addition line 22.

The flow rate adjustment valve 23 is provided in the middle of the addition line 22. A degree of opening of the flow rate adjustment valve 23 can be adjusted by the control of the control apparatus 60A. The flow rate adjustment valve 23 can adjust an amount of addition of sodium hydroxide to the cooling liquid L1 in the cooling liquid supply line 102 through the addition line 22 by adjusting its degree of opening.

The pH detection unit 203 detects the hydrogen ion exponent (pH) of the cooling liquid L1. The pH detection unit 203, for example, detects the hydrogen ion exponent of the cooling liquid L1 circulating in the cooling liquid supply line 102. In the present embodiment, the pH detection unit 203 is arranged between the cooling liquid supply pump 31 and one end of the addition line 22. The pH detection unit 203 repeatedly detects the hydrogen ion exponent of the cooling liquid L1 circulating in the cooling liquid supply line 102 at regular time intervals. The pH detection unit 203 outputs a value of the hydrogen ion exponent of the detected cooling liquid L1 to the control apparatus 60A.

The state detection unit 201 detects a state of the amine-based absorbing liquid L2 in the absorption tower 12. The state detection unit 201 in the present embodiment detects the state of the amine-based absorbing liquid L2 in the tower body 12*a* of the absorption tower 12. The state detection unit 201 in the present embodiment detects the state of the amine-based absorbing liquid L2 at the bottom portion in the absorption tower 12. The state detection unit 201, for example, detects the state of the amine-based absorbing liquid L2 discharged from the bottom portion of the absorption tower 12 and circulating in the absorbing liquid discharge line 106B.

In the present embodiment, the state detection unit 201 detects an oxidation-reduction potential (ORP) of the amine-based absorbing liquid L2 as a state of the amine-based absorbing liquid L2. The state detection unit 201 repeatedly detects the oxidation-reduction potential of the amine-based absorbing liquid L2 in the absorption tower 12 at regular time intervals. The state detection unit 201 outputs a value of the detected oxidation-reduction potential of the amine-based absorbing liquid L2 to the control apparatus 60A.

(Hardware Configuration Diagram)

Figure 2:
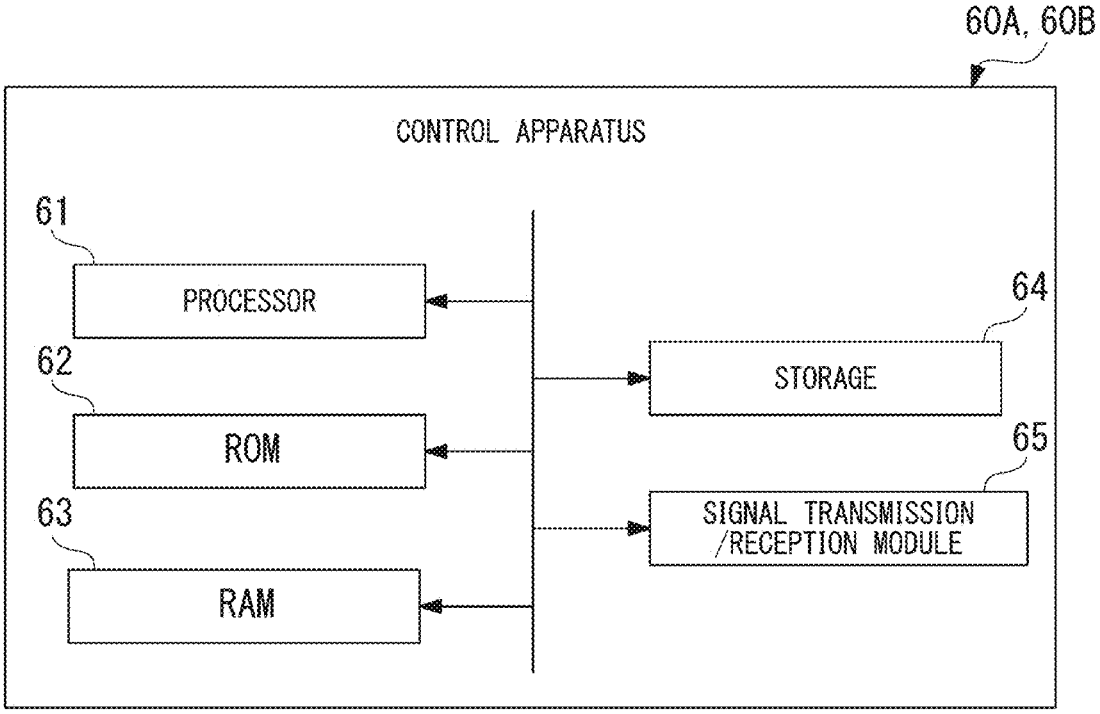
FIG. 2 is a diagram showing a hardware configuration of a control apparatus of an exhaust gas treatment system according to an embodiment of the present disclosure.

FIG. 2 is a diagram showing a hardware configuration of a control apparatus of an exhaust gas treatment system according to an embodiment of the present disclosure.

As shown in FIG. 2, the control apparatus 60A is a computer including a processor 61 such as a central processing unit (CPU), a read-only memory (ROM) 62, a random-access memory (RAM) 63, a storage 64, and a signal transmission/reception module 65. The signal transmission/reception module 65 receives signals related to the hydrogen ion exponent of the cooling liquid L1 and the oxidation-reduction potential of the amine-based absorbing liquid L2 from the pH detection unit 203 and the state detection unit 201.

(Functional Block Diagram)

Figure 3:
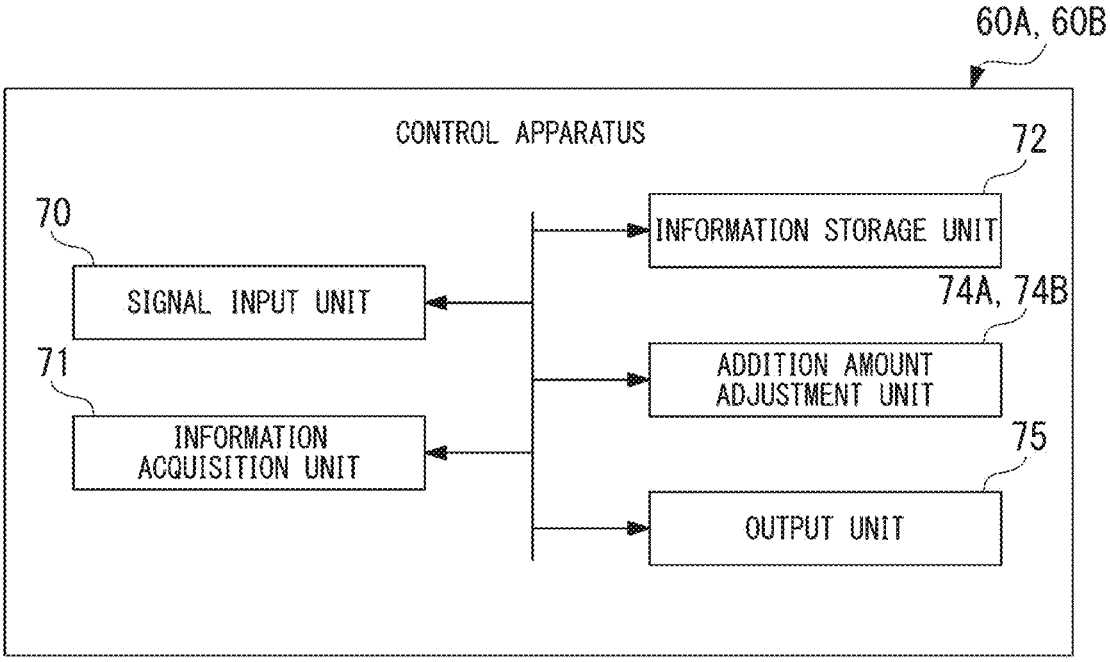
FIG. 3 is a functional block diagram of the control apparatus of the exhaust gas treatment system according to the embodiment of the present disclosure.

FIG. 3 is a functional block diagram of a control apparatus of an exhaust gas treatment system according to an embodiment of the present disclosure.

As shown in FIG. 3, the processor 61 of the control apparatus 60A executes a program stored in advance in a storage apparatus such as the ROM 62 or the storage 64, thereby implementing configurations of a signal input unit 70, an information acquisition unit 71, an information storage unit 72, an addition amount adjustment unit 74A, and an output unit 75.

The signal input unit 70 receives signals related to the hydrogen ion exponent of the cooling liquid L1 and the oxidation-reduction potential of the amine-based absorbing liquid L2 from the pH detection unit 203 and the state detection unit 201 via the signal transmission/reception module 65, which is hardware.

On the basis of the signals received by the signal input unit 70, the information acquisition unit 71 acquires values of the hydrogen ion exponent of the cooling liquid L1 and the oxidation-reduction potential of the amine-based absorbing liquid L2 detected by the pH detection unit 203 and the state detection unit 201.

Figure 4:
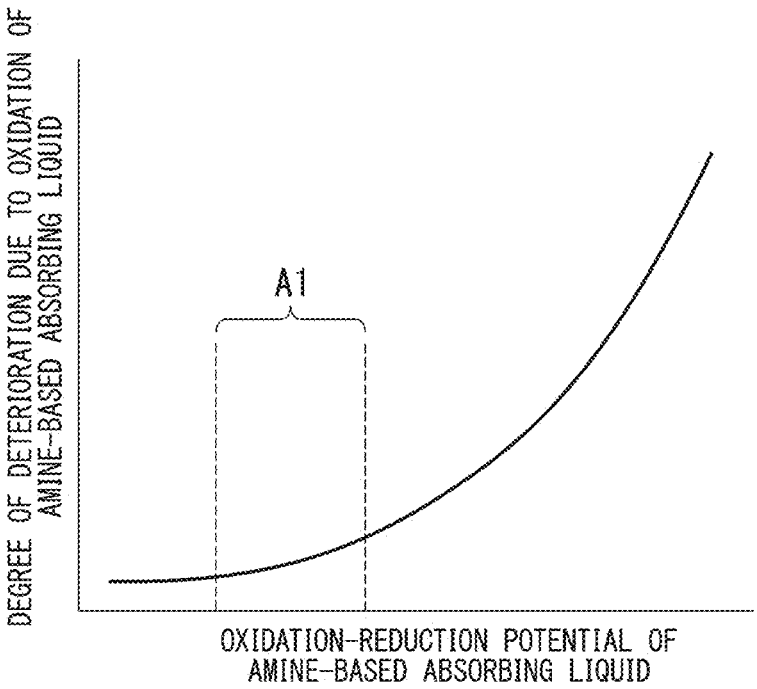
FIG. 4 is a diagram showing an example of correlation information about a correlation between an oxidation-reduction potential of the amine-based absorbing liquid and a degree of deterioration due to oxidation of the amine-based absorbing liquid stored in the control apparatus according to the embodiment of the present disclosure.
Figure 5:
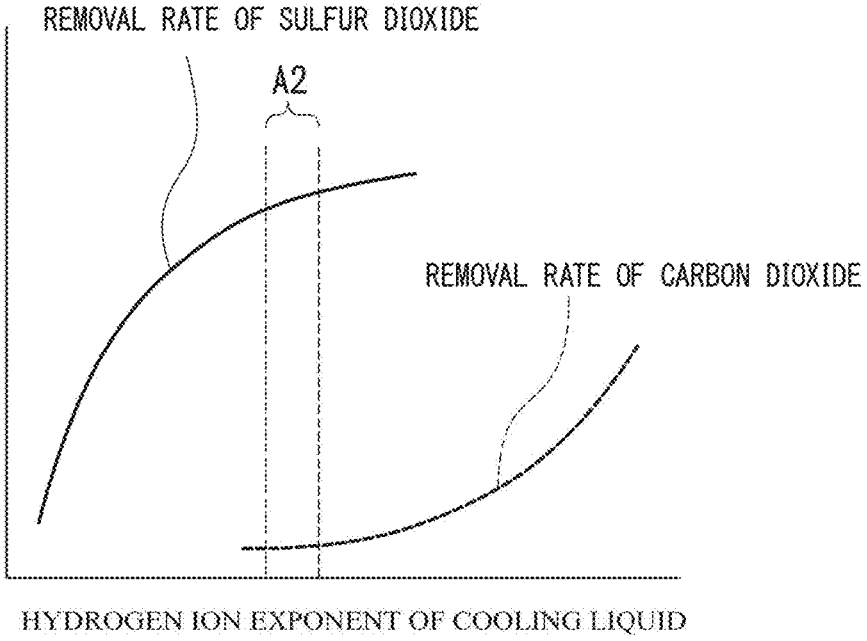
FIG. 5 is a diagram showing an example of correlation information about correlations between a hydrogen ion exponent of a cooling liquid and a removal rate of sulfur dioxide in a cooling tower and a removal rate of carbon dioxide in the absorption tower stored in the control apparatus according to the embodiment of the present disclosure.

FIG. 4 is a diagram showing an example of correlation information about a correlation between an oxidation-reduction potential of the amine-based absorbing liquid and a degree of deterioration due to oxidation of the amine-based absorbing liquid stored in the control apparatus according to the embodiment of the present disclosure. FIG. 5 is a diagram showing an example of correlation information about a correlation between a hydrogen ion exponent of the cooling liquid, a removal rate of sulfur dioxide in the cooling tower, and a removal rate of carbon dioxide in the absorption tower stored in the control apparatus according to the embodiment of the present disclosure.

For example, as shown in FIG. 4, the information storage unit 72 stores correlation information about a correlation between the oxidation-reduction potential of the amine-based absorbing liquid L2 and the degree of deterioration due to oxidation of the amine-based absorbing liquid L2. The information storage unit 72 stores a management range A1 of the oxidation-reduction potential preset on the basis of this correlation information. In this management range A1, a range of oxidation-reduction potentials in which aldehydes are less likely to be generated is set in the amine-based absorbing liquid L2.

Moreover, as shown in FIG. 5, for example, the information storage unit 72 stores correlation information about a correlation between the hydrogen ion exponent of the cooling liquid L1, a removal rate of sulfur dioxide in the cooling tower 11, and a removal rate of carbon dioxide in the absorption tower 12. The information storage unit 72 stores a pH range A2 set in advance on the basis of this correlation information. The pH range A2 is set so that the oxidation potential of the amine-based absorbing liquid L2 is in the management range A1.

The correlation information is acquired in advance by performing a test operation of the exhaust gas treatment system 10A or the like.

In addition, the information storage unit 72 may store only upper and lower limit threshold values of the management range A1 and the pH range A2 without storing the correlation information as shown in FIGS. 4 and 5.

The addition amount adjustment unit 74A adjusts an amount of addition of sodium hydroxide in the addition unit 21 on the basis of the hydrogen ion exponent of the cooling liquid L1 and the oxidation-reduction potential of the amine-based absorbing liquid L2 detected by the pH detection unit 203 and the state detection unit 201.

The addition amount adjustment unit 74A adjusts the amount of addition of sodium hydroxide in the addition unit 21 on the basis of the oxidation-reduction potential of the amine-based absorbing liquid L2 detected by the state detection unit 201. The addition amount adjustment unit 74A adjusts the amount of addition of sodium hydroxide in the addition unit 21 so that the oxidation-reduction potential of the amine-based absorbing liquid L2 is less than or equal to the upper limit threshold value of the preset management range A1.

Moreover, the addition amount adjustment unit 74A manages the hydrogen ion exponent of the cooling liquid L1 in a state in which the amount of addition of sodium hydroxide is adjusted on the basis of the oxidation-reduction potential of the amine-based absorbing liquid L2 as described above. The addition amount adjustment unit 74A adjusts the amount of addition of sodium hydroxide in the addition unit 21 as necessary on the basis of the hydrogen ion exponent of the cooling liquid L1 detected by the pH detection unit 203. The addition amount adjustment unit 74A adjusts the amount of addition of sodium hydroxide in the addition unit 21 so that the hydrogen ion exponent of the cooling liquid L1 is in the preset pH range A2.

The output unit 75 outputs a control signal for changing the amount of addition of sodium hydroxide in the addition unit 21 on the basis of the control of the addition amount adjustment unit 74A.

(Procedure of Exhaust Gas Treatment Method)

Figure 6:
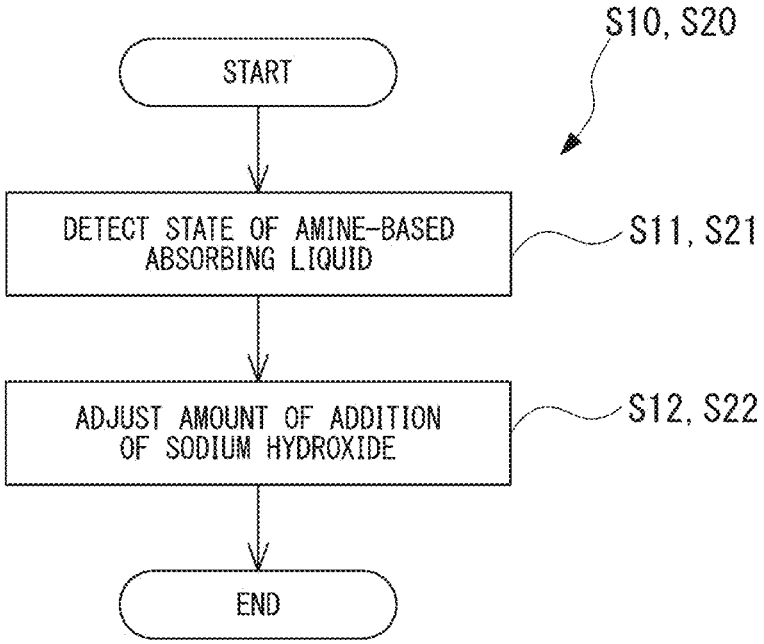
FIG. 6 is a flowchart showing a flow of an exhaust gas treatment method according to the embodiment of the present disclosure.

FIG. 6 is a flowchart showing a flow of an exhaust gas treatment method according to an embodiment of the present disclosure. In the present embodiment, in the exhaust gas treatment method S10 shown below, the control apparatus 60A is implemented by sequentially executing a process based on a program stored in advance.

As shown in FIG. 6, the exhaust gas treatment method S10 according to the present embodiment includes step S11 of detecting a state of an amine-based absorbing liquid and step S12 of adjusting an amount of addition of sodium hydroxide.

In step S11 of detecting the state of the amine-based absorbing liquid, information including the oxidation-reduction potential of the amine-based absorbing liquid L2 and the hydrogen ion exponent of the cooling liquid L1 is acquired. Thereby, the signal input unit 70 receives the oxidation-reduction potential of the amine-based absorbing liquid L2 detected by the state detection unit 201 and the hydrogen ion exponent of the cooling liquid L1 detected by the pH detection unit 203 at regular time intervals. The information acquisition unit 71 acquires the oxidation-reduction potential of the amine-based absorbing liquid L2 and the hydrogen ion exponent of the cooling liquid L1 on the basis of the signals received by the signal input unit 70.

In step S12 of adjusting the amount of addition of sodium hydroxide, the addition amount adjustment unit 74A adjusts the amount of addition of sodium hydroxide in the addition unit 21 on the basis of the oxidation-reduction potential of the amine-based absorbing liquid L2 and the hydrogen ion exponent of the cooling liquid L1 acquired in the information acquisition unit 71.

In the present embodiment, the addition amount adjustment unit 74A adjusts the amount of addition of sodium hydroxide in the addition unit 21 so that the oxidation-reduction potential of the amine-based absorbing liquid L2 is less than or equal to the upper limit threshold value of the preset management range A1. For example, when the oxidation-reduction potential of the amine-based absorbing liquid L2 detected by the state detection unit 201 exceeds the management range A1, the addition amount adjustment unit 74A reduces the degree of opening of the flow rate adjustment valve 23 and reduces the amount of addition of sodium hydroxide in the addition unit 21. When the amount of addition of sodium hydroxide to the cooling liquid L1 decreases, the removal rate of sulfur dioxide in the cooling tower 11 decreases. Thereby, an amount of sulfur dioxide coming into the absorption tower 12 increases in a state in which sulfur dioxide is not removed by the cooling tower 11. Sulfur dioxide coming into the absorption tower 12 reacts with water contained in the amine-based absorbing liquid L2 to generate sulfurous acid. The generated sulfurous acid reacts with dissolved oxygen in the amine-based absorbing liquid L2. Thereby, oxygen in the absorption tower 12 is consumed. The reaction between this sulfurous acid and the dissolved oxygen in the amine-based absorbing liquid L2 occurs earlier than the reaction between the amine contained in the amine-based absorbing liquid L2 and the oxygen contained in the exhaust gas. For this reason, oxidation of the amine-based absorbing liquid L2 in the absorption tower 12 can be suppressed and the generation of aldehydes can be suppressed. That is, the addition amount adjustment unit 74A sets the oxidation-reduction potential of the amine-based absorbing liquid L2 in the management range A1 and therefore aldehydes are less likely to be generated due to oxidative deterioration in the absorption tower 12.

Moreover, the addition amount adjustment unit 74A manages the hydrogen ion exponent of the cooling liquid L1 in a state in which the amount of addition of sodium hydroxide in the addition unit 21 is adjusted on the basis of the oxidation-reduction potential of the amine-based absorbing liquid L2. The addition amount adjustment unit 74A adjusts the amount of addition of sodium hydroxide in the addition unit 21 so that the hydrogen ion exponent of the cooling liquid L1 is in the preset pH range A2. When the hydrogen ion exponent of the cooling liquid L1 detected by the pH detection unit 203 exceeds the pH range A2, the addition amount adjustment unit 74A reduces the degree of opening of the flow rate adjustment valve 23 and reduces the amount of addition of sodium hydroxide in the addition unit 21. That is, the addition amount adjustment unit 74A manages the removal rate of sulfur dioxide with the cooling liquid L1 in the cooling tower 11 by setting the hydrogen ion exponent of the cooling liquid L1 in the pH range A2.

During the operation of the exhaust gas treatment system 10A, the control apparatus 60A repeatedly executes steps S11 and S12 as described above at regular time intervals.

(Operation and Effects)

In the exhaust gas treatment system 10A, the absorbing liquid management apparatus 20A, and the exhaust gas treatment method S10 having the above configuration, the amount of addition of sodium hydroxide as an additive to the cooling liquid L1 of the cooling tower 11 is adjusted on the basis of a state of the amine-based absorbing liquid L2. In the cooling tower 11, sulfur dioxide contained in the exhaust gas is removed by bringing the cooling liquid L1 into contact with the exhaust gas. When the amount of addition of sodium hydroxide to the cooling liquid L1 is reduced, the removal rate of sulfur dioxide in the cooling tower 11 decreases. Thereby, an amount of sulfur dioxide coming into the absorption tower 12 increases in a state in which sulfur dioxide is not removed by the cooling tower 11. Sulfur dioxide coming into the absorption tower 12 reacts with water contained in the amine-based absorbing liquid L2 to generate sulfurous acid. The generated sulfurous acid reacts with dissolved oxygen in the amine-based absorbing liquid L2. Thereby, oxygen in the absorption tower 12 is consumed. The reaction between this sulfurous acid and the dissolved oxygen in the amine-based absorbing liquid L2 occurs earlier than the reaction between the amine contained in the amine-based absorbing liquid L2 and the oxygen contained in the exhaust gas. For this reason, oxidation of the amine-based absorbing liquid L2 in the absorption tower 12 can be suppressed and the generation of aldehydes can be suppressed. Thus, the oxidation of the amine-based absorbing liquid L2 is suppressed by adjusting the amount of addition of sodium hydroxide to the cooling liquid L1 in accordance with the state of the amine-based absorbing liquid L2, such that the labor and cost of replacement of the amine-based absorbing liquid L2 are minimized. As a result, it is possible to effectively suppress oxidative deterioration of the absorbing liquid while minimizing labor and cost.

Moreover, because the oxygen concentration in the absorption tower 12 decreases, corrosion of a metallic material forming the absorption tower 12 can be suppressed. Thereby, the elution of the metallic material forming the absorption tower 12 into the amine-based absorbing liquid L2 can be suppressed and deterioration of the amine-based absorbing liquid L2 can be suppressed in this regard as well.

Moreover, the control apparatus 60A adjusts the amount of addition of sodium hydroxide so that the hydrogen ion exponent of the cooling liquid L1 detected by the pH detection unit 203 is in the preset pH range A2. Thereby, the removal rate of sulfur dioxide in the cooling tower 11 can be maintained in an appropriate range. Therefore, the oxidation of the amine-based absorbing liquid L2 in the absorption tower 12 can be effectively suppressed.

Moreover, the state detection unit 201 detects the state of the amine-based absorbing liquid L2 at the bottom portion of the absorption tower 12. Thereby, the amount of addition of sodium hydroxide can be adjusted sequentially on the basis of the state of the amine-based absorbing liquid L2 after carbon dioxide or the like contained in the exhaust gas in the absorption tower 12 is absorbed.

Moreover, the state detection unit 201 detects the oxidation-reduction potential of the amine-based absorbing liquid L2. Thereby, the oxidation state of the amine-based absorbing liquid L2 can be ascertained and the amount of addition of sodium hydroxide can be appropriately adjusted.

Moreover, the control apparatus 60A reduces the amount of addition of sodium hydroxide when the oxidation-reduction potential of the detected amine-based absorbing liquid L2 is greater than or equal to the preset upper limit threshold value. Thereby, the hydroxide ion concentration (or pH) of the cooling liquid L1 can be reduced and the removal rate of sulfur dioxide in the cooling tower 11 can be reduced. Therefore, the consumption of oxygen in the absorption tower 12 can be increased and the oxidation of the amine-based absorbing liquid L2 in the absorption tower 12 can be effectively suppressed.

Moreover, the oxidation of the amine-based absorbing liquid L2 is suppressed by adjusting an amount of addition for the cooling liquid L1 using at least one selected from the group of sodium hydroxide, potassium hydroxide, calcium hydroxide, sodium carbonate, potassium carbonate, calcium carbonate, and magnesium hydroxide as an additive.

Second Embodiment

Next, a second embodiment of the exhaust gas treatment system and the exhaust gas treatment method according to the present disclosure will be described. In addition, in the second embodiment to be described below, components identical to those of the first embodiment are denoted by the same reference signs in the drawings and description thereof will be omitted. In the second embodiment, the configuration of the absorbing liquid management apparatus 20B is different from the first embodiment.

Figure 7:
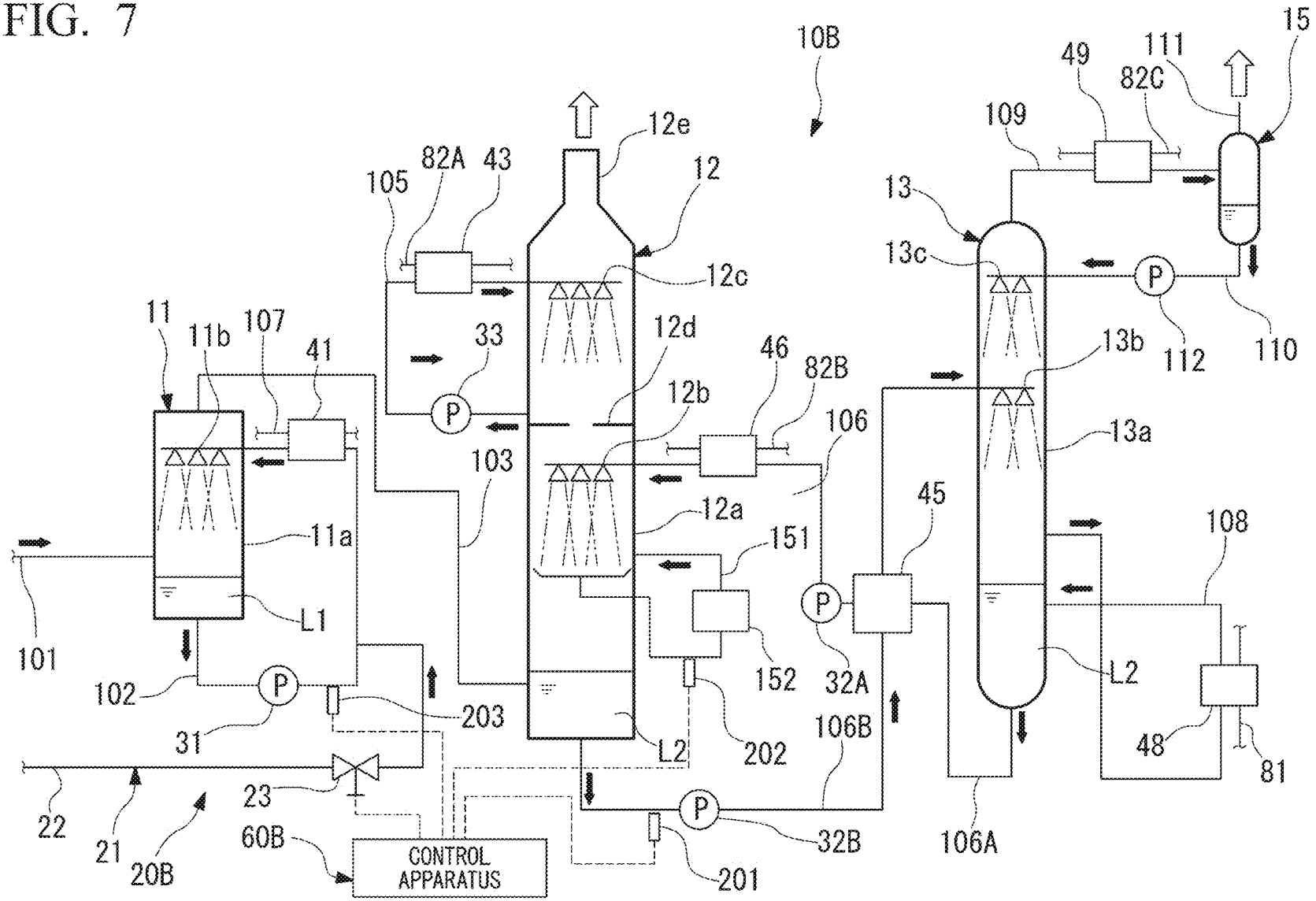
FIG. 7 is a diagram showing a configuration of an exhaust gas treatment system according to a second embodiment of the present disclosure.

FIG. 7 is a diagram showing a configuration of the exhaust gas treatment system according to the second embodiment of the present disclosure.

As shown in FIG. 7, the exhaust gas treatment system 10B includes a cooling tower 11, an absorption tower 12, a regeneration tower 13, a capture unit 15, and an absorbing liquid management apparatus 20B.

The absorbing liquid management apparatus 20B in the present embodiment includes an addition unit 21, state detection units 201 and 202, a pH detection unit 203, and a control apparatus 60B.

The exhaust gas treatment system 10B in the present embodiment includes an absorbing liquid cooling line 151. One end of the absorbing liquid cooling line 151 is connected to the lower side of the nozzle 12*b* in the tower body 12*a*. The other end of the absorbing liquid cooling line 151 is connected to the tower body 12*a* above the one end of the absorbing liquid cooling line 151. A cooler 152 is provided in the middle of the absorbing liquid cooling line 151. The cooler 152 cools the amine-based absorbing liquid L2 circulating in the absorbing liquid cooling line 151 with cooling water supplied from the outside. The absorbing liquid cooling line 151 cools the amine-based absorbing liquid L2 extracted from an intermediate portion in a vertical direction in the absorption tower 12 above the bottom portion of the absorption tower 12 and supplies the amine-based absorbing liquid L2 into the absorption tower 12. The absorbing liquid cooling line 151 cools the amine-based absorbing liquid L2 whose temperature has risen by absorbing carbon dioxide in the absorption tower 12 and returns the amine-based absorbing liquid L2 into the absorption tower 12.

The state detection unit 202 is provided in the absorbing liquid cooling line 151. The state detection unit 202 detects a state of the amine-based absorbing liquid L2 circulating in the absorbing liquid cooling line 151. In the present embodiment, the state detection unit 202 detects the state of the amine-based absorbing liquid L2 supplied to the absorption tower 12. In the present embodiment, the state detection unit 202 detects an oxidation-reduction potential of the amine-based absorbing liquid L2 as the state of the amine-based absorbing liquid L2. The state detection unit 202 repeatedly detects the oxidation-reduction potential of the amine-based absorbing liquid L2 in the absorption tower 12 at regular time intervals. The state detection unit 202 outputs a value of the detected oxidation-reduction potential of the amine-based absorbing liquid L2 to the control apparatus 60A.

As shown in FIG. 3, the processor 61 of the control apparatus 60B in the present embodiment executes a program stored in advance in a storage apparatus such as a ROM 62 or a storage 64, thereby implementing configurations of a signal input unit 70, an information acquisition unit 71, an information storage unit 72, an addition amount adjustment unit 74B, and an output unit 75.

In addition to the hydrogen ion exponent of the cooling liquid L1 detected by the pH detection unit 203 and the oxidation-reduction potential of the amine-based absorbing liquid L2 detected by the state detection unit 201, the addition amount adjustment unit 74B adjusts an amount of addition of sodium hydroxide in the addition unit 21 on the basis of the oxidation-reduction potential of the amine-based absorbing liquid L2 detected by the state detection unit 202.

The addition amount adjustment unit 74B adjusts the amount of addition of sodium hydroxide in the addition unit 21 detected by the state detection unit 202 on the basis of the oxidation-reduction potential of the amine-based absorbing liquid L2 detected by the state detection unit 202. The addition amount adjustment unit 74B adjusts the amount of addition of sodium hydroxide in the addition unit 21 so that the oxidation-reduction potential of the amine-based absorbing liquid L2 is less than or equal to an upper limit threshold value of the preset management range.

Moreover, the addition amount adjustment unit 74B may be configured to adjust the amount of addition of sodium hydroxide in the addition unit 21 on the basis of a difference between the oxidation-reduction potential of the amine-based absorbing liquid L2 detected by the state detection unit 202 and the oxidation-reduction potential of the amine-based absorbing liquid L2 detected by the state detection unit 201.

When the carbon dioxide absorption reaction in the amine-based absorbing liquid L2 occurs at a certain level or higher, the difference between the oxidation-reduction potential of the amine-based absorbing liquid L2 detected by the state detection unit 202 and the oxidation-reduction potential of the amine-based absorbing liquid L2 detected by the state detection unit 201 is greater than or equal to a predetermined value. On the other hand, when the amount of carbon dioxide absorbed in the amine-based absorbing liquid L2 increases (approaching a limit value of the absorption amount), the degree of carbon dioxide absorption reaction in the amine-based absorbing liquid L2 decreases. Then, the difference between the oxidation-reduction potential of the amine-based absorbing liquid L2 detected by the state detection unit 202 and the oxidation-reduction potential of the amine-based absorbing liquid L2 detected by the state detection unit 201 decreases.

Therefore, the addition amount adjustment unit 74B decreases the amount of addition of sodium hydroxide in the addition unit 21 when the difference between the oxidation-reduction potential of the amine-based absorbing liquid L2 detected by the state detection unit 202 and the oxidation-reduction potential of the amine-based absorbing liquid L2 detected by the state detection unit 201 is less than a preset predetermined value.

(Procedure of Exhaust Gas Treatment Method)

As shown in FIG. 6, the exhaust gas treatment method S20 according to the present embodiment includes step S21 of detecting the state of the amine-based absorbing liquid and step S22 of adjusting the amount of addition of sodium hydroxide.

In step S21 of detecting the state of the amine-based absorbing liquid, in addition to the hydrogen ion exponent of the cooling liquid L1 detected by the pH detection unit 203 and the oxidation-reduction potential of the amine-based absorbing liquid L2 detected by the state detection unit 201, the oxidation-reduction potential of the amine-based absorbing liquid L2 detected by the state detection unit 202 is acquired.

In step S22 of adjusting the amount of addition of sodium hydroxide, the addition amount adjustment unit 74B adjusts the amount of addition of sodium hydroxide in the addition unit 21 on the basis of the oxidation-reduction potential of the amine-based absorbing liquid L2 detected by the state detection unit 202 in addition to the adjustment of the amount of addition of sodium hydroxide in the addition unit 21 on the basis of the hydrogen ion exponent of the cooling liquid L1 detected by the pH detection unit 203 and the oxidation-reduction potential of the amine-based absorbing liquid L2 detected by the state detection unit 201 as in the first embodiment.

The addition amount adjustment unit 74B adjusts the amount of addition of sodium hydroxide in the addition unit 21 so that the oxidation-reduction potential of the amine-based absorbing liquid L2 detected by the state detection unit 202 is less than or equal to the upper limit threshold value of the preset management range.

Moreover, the addition amount adjustment unit 74B decreases the amount of addition of sodium hydroxide in the addition unit 21 when a difference between the oxidation-reduction potential of the amine-based absorbing liquid L2 detected by the state detection unit 202 and the oxidation-reduction potential of the amine-based absorbing liquid L2 detected by the state detection unit 201 is less than a preset predetermined value.

During the operation of the exhaust gas treatment system 10B, the control apparatus 60B repeatedly executes steps S21 and S22 as described above at regular time intervals.

(Operation and Effects)

In the exhaust gas treatment system 10B, the absorbing liquid management apparatus 20B, and the exhaust gas treatment method S20 having the above configuration, as in the first embodiment, the labor or cost of replacement of the amine-based absorbing liquid L2 because the oxidation of the amine-based absorbing liquid L2 can be suppressed by adjusting the amount of addition of sodium hydroxide for cooling in accordance with the state of the amine-based absorbing liquid L2. As a result, it is possible to effectively suppress oxidative deterioration of the absorbing liquid while suppressing the labor and cost.

Moreover, the state detection unit 202 detects the state of the amine-based absorbing liquid L2 circulating in the absorbing liquid cooling line 151. Thereby, the amount of addition of sodium hydroxide can be adjusted sequentially by detecting the state of the amine-based absorbing liquid L2 extracted from an intermediate portion in the absorption tower 12 and supplied into the absorption tower 12.

Moreover, the control apparatus 60A adjusts the amount of addition of sodium hydroxide on the basis of the difference between the state of the amine-based absorbing liquid L2 circulating in the absorbing liquid cooling line 151 and the state of the amine-based absorbing liquid L2 at the bottom portion of the absorption tower 12. Thereby, the amount of addition of sodium hydroxide can be appropriately adjusted on the basis of a state of the amine in the amine-based absorbing liquid L2.

Other Embodiments

Although embodiments of the present disclosure have been described above in detail with reference to the drawings, a specific configuration is not limited to these embodiments and design changes and the like may be included without departing from the spirit and scope of the present disclosure.

Although the state detection units 201 and 202 detect the oxidation-reduction potential of the amine-based absorbing liquid L2 in each of the above-described embodiments, the present disclosure is not limited thereto. In the state detection units 201 and 202, the dissolved oxygen concentration of the amine-based absorbing liquid L2 may be detected as the state of the amine-based absorbing liquid L2.

Moreover, the additive added in the addition unit 21 is not limited to the substance exemplified in the examples or the present specification and may be a substance that can adjust the cooling liquid L1 to a predetermined pH.

In addition, a program for implementing all or some functions of the control apparatuses 60A and 60B is recorded on a computer-readable recording medium and the program recorded on the recording medium is read into a computer system and executed, such that a process of each functional unit may be performed. The "computer system" used here is assumed to include an operating system (OS) or hardware such as peripheral devices. The "computer system" is also assumed to include a homepage provision environment (or display environment) when a WWW system is used. Moreover, the "computer-readable recording medium" refers to a portable medium such as a CD, a DVD, or a USB, and a storage apparatus such as a hard disk built into a computer system.

Moreover, when this program is distributed to the control apparatuses 60A and 60B through a communication circuit, the control apparatuses 60A and 60B receiving the distributed program may load the program into the storage 64 and execute the above process. Also, the above-described program may be a program for implementing some of the above-described functions. Further, the above-described program may be implemented in combination with a program already recorded on the computer system.

Appendix

The exhaust gas treatment systems 10A and 10B, the absorbing liquid management apparatuses 20A and 20B, and the exhaust gas treatment methods S10 and S20 are ascertained, for example, as follows.

(1) According an aspect, there is provided an exhaust gas treatment system 10A or 10B including: a cooling tower 11 configured to cool exhaust gas by bringing the exhaust gas containing carbon dioxide into contact with a cooling liquid L1; an absorption tower 12 in which an amine-based absorbing liquid L2 capable of absorbing the carbon dioxide in the exhaust gas is introduced and the carbon dioxide in the exhaust gas passing through the cooling tower 11 is absorbed by the amine-based absorbing liquid L2; a regeneration tower 13 configured to heat the amine-based absorbing liquid L2 absorbing the carbon dioxide, separate the carbon dioxide from the amine-based absorbing liquid L2, and regenerate the amine-based absorbing liquid L2; an addition unit 21 configured to add an additive for adjusting a hydroxide ion concentration of the cooling liquid L1 to the cooling liquid L1; a state detection unit 201 configured to detect a state of the amine-based absorbing liquid L2; and a control apparatus 60A or 60B configured to adjust an amount of addition of the additive in the addition unit 21 on the basis of a state of the amine-based absorbing liquid L2 detected by the state detection unit 201.

These exhaust gas treatment system 10A or 10B adjusts the amount of addition of sodium hydroxide as an additive to the cooling liquid L1 of the cooling tower 11 on the basis of a state of the amine-based absorbing liquid L2. In the cooling tower 11, sulfur dioxide ($SO_2$) contained in the exhaust gas is removed by bringing the cooling liquid L1 into contact with the exhaust gas. When the amount of addition of sodium hydroxide to the cooling liquid L1 is reduced, the removal rate of sulfur dioxide in the cooling tower 11 decreases. Thereby, an amount of sulfur dioxide coming into the absorption tower 12 increases in a state in which sulfur dioxide is not removed by the cooling tower 11. Sulfur dioxide coming into the absorption tower 12 reacts with water contained in the amine-based absorbing liquid L2 to generate sulfurous acid. The generated sulfurous acid reacts with dissolved oxygen in the amine-based absorbing liquid L2. Thereby, oxygen in the absorption tower 12 is consumed. The reaction between this sulfurous acid and the dissolved oxygen in the amine-based absorbing liquid L2 occurs earlier than the reaction between the amine contained in the amine-based absorbing liquid L2 and the oxygen contained in the exhaust gas. For this reason, oxidation of the amine-based absorbing liquid L2 in the absorption tower 12 can be suppressed and the generation of aldehydes can be suppressed. Thus, the oxidation of the amine-based absorbing liquid L2 is suppressed by adjusting the amount of addition of sodium hydroxide to the cooling liquid L1 in accordance with the state of the amine-based absorbing liquid L2, such that the labor and cost of replacement of the amine-based absorbing liquid L2 are minimized. As a result, it is possible to effectively suppress oxidative deterioration of the absorbing liquid while minimizing labor and cost.

Moreover, because the oxygen concentration in the absorption tower 12 decreases, corrosion of a metallic material forming the absorption tower 12 can be suppressed. Thereby, the elution of the metallic material into the amine-based absorbing liquid L2 can be suppressed and deterioration of the amine-based absorbing liquid L2 can be suppressed in this regard as well.

(2) According to a second aspect, the exhaust gas treatment system 10A or 10B according to (1) further includes a pH detection unit 203 configured to detect the hydrogen ion exponent of the cooling liquid L1, wherein the control apparatus 60A or 60B adjusts the amount of addition of the additive so that the hydrogen ion exponent of the cooling liquid L1 detected by the pH detection unit 203 is in a preset pH range.

According to such a configuration, it is possible to maintain the removal rate of sulfur dioxide in the cooling tower 11 in an appropriate range by adjusting the amount of addition of the additive on the basis of the hydrogen ion exponent of the cooling liquid L1 and setting the hydrogen ion exponent of the cooling liquid L1 in the preset pH range. Thereby, the oxidation of the amine-based absorbing liquid L2 in the absorption tower 12 can be effectively suppressed.

(3) According to a third aspect, in the exhaust gas treatment system 10A or 10B according to (1) or (2), the state detection unit 201 detects the state of the amine-based absorbing liquid L2 at a bottom portion of the absorption tower 12.

According to such a configuration, the state of the amine-based absorbing liquid L2 at the bottom portion of the absorption tower 12 is detected, such that the amount of addition of sodium hydroxide can be adjusted sequentially on the basis of the state of the amine-based absorbing liquid L2 after carbon dioxide or the like contained in the exhaust gas in the absorption tower 12 is absorbed.

(4) According to a fourth aspect, in the exhaust gas treatment system 10A or 10B according to any one of (1) to (3), the absorption tower 12 further includes an absorbing liquid cooling line 151 for cooling the amine-based absorbing liquid L2 extracted from an intermediate portion in the absorption tower 12 and supplying the cooled amine-based absorbing liquid L2 into the absorption tower 12, and the state detection unit 202 detects a state of the amine-based absorbing liquid L2 circulating through the absorbing liquid cooling line 151.

According to such a configuration, the amount of addition of the additive can be adjusted sequentially by detecting the state of the amine-based absorbing liquid L2 extracted from the intermediate portion in the absorption tower 12 and supplied into the absorption tower 12.

(5) According to a fifth aspect, in the exhaust gas treatment system 10B according to (4), the state detection unit 201 detects a state of the amine-based absorbing liquid L2 at a bottom portion in the absorption tower 12, and the control apparatus 60A or 60B adjusts the amount of addition of the additive on the basis of a difference between the state of the amine-based absorbing liquid L2 circulating through the absorbing liquid cooling line 151 and the state of the amine-based absorbing liquid L2 at the bottom portion of the absorption tower 12.

According to such a configuration, the amount of addition of the additive can be appropriately adjusted on the state of the amine in the amine-based absorbing liquid L2 by adjusting the amount of addition of the additive on the basis of the difference between the state of the amine-based absorbing liquid L2 circulating through the absorbing liquid cooling line 151 and the state of the amine-based absorbing liquid L2 at the bottom portion of the absorption tower 12.

(6) According to a sixth embodiment, in the exhaust gas treatment system 10A or 10B according to any one of (1) to (5), the state detection unit 201 detects an oxidation-reduction potential of the amine-based absorbing liquid L2.

According to such a configuration, the oxidation state of the amine-based absorbing liquid L2 can be ascertained by detecting the oxidation-reduction potential of the amine-based absorbing liquid L2. Thereby, the amount of addition of the additive can be adjusted sequentially.

(7) According to a seventh aspect, in the exhaust gas treatment system 10A or 10B according to (6), the control apparatus 60A or 60B reduces the amount of addition of the additive when the detected oxidation-reduction potential of the amine-based absorbing liquid L2 is greater than or equal to a preset upper limit threshold value.

According to such a configuration, when the oxidation-reduction potential of the detected amine-based absorbing liquid L2 is greater than or equal to the preset upper limit threshold value, the amount of addition of sodium hydroxide is reduced, such that the hydroxide ion concentration of the cooling liquid L1 can be reduced and the removal rate of sulfur dioxide in the cooling tower 11 can be reduced. Therefore, the consumption of oxygen in the absorption tower 12 can be increased and the oxidation of the amine-based absorbing liquid L2 in the absorption tower 12 can be effectively suppressed.

(8) According to an eighth aspect, in the exhaust gas treatment system 10A or 10B according to any one of (1) to (7), the state detection unit 201 detects a dissolved oxygen concentration of the amine-based absorbing liquid L2.

According to such a configuration, the oxidation state of the amine-based absorbing liquid L2 can be ascertained by detecting the dissolved oxygen concentration of the amine-based absorbing liquid L2. Thereby, the amount of addition as the additive can be appropriately adjusted.

(9) According to a ninth aspect, in the exhaust gas treatment system 10A or 10B according to any one of (1) to (8), the additive contains at least one selected from the group of sodium hydroxide, potassium hydroxide, calcium hydroxide, sodium carbonate, potassium carbonate, calcium carbonate, and magnesium hydroxide.

According to such a configuration, the oxidation of the amine-based absorbing liquid L2 can be suppressed by adjusting the amount of addition for the cooling liquid L1 using at least one selected from the group of sodium hydroxide, potassium hydroxide, calcium hydroxide, sodium carbonate, potassium carbonate, calcium carbonate, and magnesium hydroxide as the additive.

(10) According to a tenth aspect, there is provided an absorbing liquid management apparatus 20A or 20B provided in an exhaust gas treatment system 10A or 10B including a cooling tower 11 configured to cool exhaust gas by bringing the exhaust gas containing carbon dioxide into contact with a cooling liquid L1, an absorption tower 12 in which an amine-based absorbing liquid L2 capable of absorbing the carbon dioxide in the exhaust gas is introduced and the carbon dioxide in the exhaust gas passing through the cooling tower 11 is absorbed by the amine-based absorbing liquid L2, and a regeneration tower 13 configured to heat the amine-based absorbing liquid L2 absorbing the carbon dioxide, separate the carbon dioxide from the amine-based absorbing liquid L2, and regenerate the amine-based absorbing liquid L2, the absorbing liquid management apparatus 20A or 20B including: an addition unit 21 configured to add an additive for adjusting a hydroxide ion concentration of the cooling liquid L1 to the cooling liquid L1; a state detection unit 201 configured to detect a state of the amine-based absorbing liquid L2; and a control apparatus 60A or 60B configured to adjust an amount of addition of the additive in the addition unit 21 on the basis of a state of the amine-based absorbing liquid L2 detected by the state detection unit 201.

The absorbing liquid management apparatus 20A or 20B can suppress the oxidation of the amine-based absorbing liquid L2 in the absorption tower 12 by adjusting the amount of addition of the additive on the basis of the state of the amine-based absorbing liquid L2, and suppress the generation of aldehydes. As a result, it is possible to effectively suppress oxidative deterioration of the absorbing liquid while minimizing labor and cost.

(11) According to an eleventh aspect, there is provided an exhaust gas treatment method S10 or S20 of cooling exhaust gas by bringing the exhaust gas containing carbon dioxide into contact with a cooling liquid L1, causing the carbon dioxide in the exhaust gas to be absorbed by an amine-based absorbing liquid L2 capable of absorbing the carbon dioxide in the exhaust gas, heating the amine-based absorbing liquid L2 absorbing the carbon dioxide, separating the carbon dioxide from the amine-based absorbing liquid L2, and regenerating the amine-based absorbing liquid L2, the absorbing liquid treatment method including: step S11 or S21 of detecting a state of the amine-based absorbing liquid L2; and step S12 or S22 of adjusting an amount of addition of the additive for adjusting a hydroxide ion concentration of the cooling liquid L1 for the cooling liquid L1 on the basis of the detected state of the amine-based absorbing liquid L2.

In the exhaust gas treatment methods S10 and S20, the oxidation of the amine-based absorbing liquid L2 in the absorption tower can be suppressed by adjusting the amount of addition of the additive on the basis of the state of the amine-based absorbing liquid L2, and the generation of aldehydes can be suppressed. As a result, it is possible to effectively suppress oxidative deterioration of the absorbing liquid while minimizing labor and cost.

(12) According to a twelfth aspect, in the exhaust gas treatment method S10 or S20 according to (11), step S11 or S21 of detecting the state of the amine-based absorbing liquid L2 includes further detecting the hydrogen ion exponent of the cooling liquid L1, and wherein step S12 or S22 of adjusting the addition amount includes adjusting the amount of addition of the additive so that the detected hydrogen ion exponent of the cooling liquid L1 is in a preset pH range.

According to such a configuration, it is possible to maintain the removal rate of sulfur dioxide in the cooling tower 11 in an appropriate range by adjusting the amount of addition of the additive on the basis of the hydrogen ion exponent of the cooling liquid L1 and setting the hydrogen ion exponent of the cooling liquid L1 in the preset pH range. Thereby, the oxidation of the amine-based absorbing liquid L2 in the absorption tower 12 can be effectively suppressed.

(13) According to a thirteenth aspect, in the exhaust gas treatment method S10 or S20 according to (11) or (12), step S11 or S21 of detecting the state of the amine-based absorbing liquid L2 includes detecting an oxidation-reduction potential of the amine-based absorbing liquid L2, and step S12 or S22 of adjusting the addition amount includes reducing the amount of addition of the additive when the detected oxidation-reduction potential of the amine-based absorbing liquid L2 is greater than or equal to a preset upper limit threshold value.

According to such a configuration, when the oxidation-reduction potential of the detected amine-based absorbing liquid L2 is greater than or equal to the preset upper limit threshold value, the amount of addition of sodium hydroxide is reduced, such that the hydroxide ion concentration of the cooling liquid L1 can be reduced and the removal rate of sulfur dioxide in the cooling tower 11 can be reduced. Therefore, the consumption of oxygen in the absorption tower 12 can be increased and the oxidation of the amine-based absorbing liquid L2 in the absorption tower 12 can be effectively suppressed.

EXPLANATION OF REFERENCES

10A, 10B Exhaust gas treatment system
11 Cooling tower
11*a* Tower body
11*b* Nozzle
12 Absorption tower
12*a* Tower body
12*b*, 12*c* Nozzle
12*d* Cleaning water receiver
12*e* Exhaust pipe
13 Regeneration tower
13*a* Tower body
13*b*, 13*c* Nozzle
15 Capture unit
16 Regeneration reflux tower
20A, 20B Absorbing liquid management apparatus
21 Addition unit
22 Addition line
23 Flow rate adjustment valve
31 Cooling liquid supply pump
32A First circulation pump
32B Second circulation pump
33 Absorbing liquid circulation pump
41 First heat exchanger
43 Second heat exchanger
45 Heat exchanger
46 Third heat exchanger
48 Reboiler
49 Condenser
60A, 60B Control apparatus
61 Processor
62 ROM
63 RAM

64 Storage
65 Signal transmission and reception module
70 Signal input unit
71 Information acquisition unit
72 Information storage unit
74A, 74B Addition amount adjustment unit
75 Output unit
81 Steam supply pipe
82A to 82C Cooling water supply pipe
101 Gas introduction line
102 Cooling liquid supply line
103 Exhaust gas discharge line
105 Cleaning water circulation line
106 Circulation line
106A Absorbing liquid supply line
106B Absorbing liquid discharge line
107 Refrigerant line
108 Absorbing liquid heating line
109 Gaseous carbon dioxide discharge line
110 Reflux line 111 Carbon dioxide emission pipe 112 Reflux pump 151 Absorbing liquid cooling line 152 Refrigerator
201, 202 State detection unit
203 pH detection unit
L1 Cooling liquid
L2 Amine-based absorbing liquid

What is claimed is:

1. An exhaust gas treatment system comprising:
a cooling tower configured to cool exhaust gas by bringing the exhaust gas containing carbon dioxide into contact with a cooling liquid;
an absorption tower in which an amine-based absorbing liquid capable of absorbing the carbon dioxide in the exhaust gas is introduced and the carbon dioxide in the exhaust gas passing through the cooling tower is absorbed by the amine-based absorbing liquid;
a regeneration tower configured to heat the amine-based absorbing liquid absorbing the carbon dioxide, separate the carbon dioxide from the amine-based absorbing liquid, and regenerate the amine-based absorbing liquid;
an addition unit configured to add an additive for adjusting a hydroxide ion concentration of the cooling liquid to the cooling liquid;
a state detection unit configured to detect a state of the amine-based absorbing liquid; and
a control apparatus configured to adjust an amount of addition of the additive in the addition unit based on a state of the amine-based absorbing liquid detected by the state detection unit.

2. The exhaust gas treatment system according to claim 1, further comprising:
a pH detection unit configured to detect a hydrogen ion exponent of the cooling liquid, wherein
the control apparatus adjusts the amount of addition of the additive so that the hydrogen ion exponent of the cooling liquid detected by the pH detection unit is in a preset pH range.

3. The exhaust gas treatment system according to claim 1, wherein the state detection unit detects the state of the amine-based absorbing liquid at a bottom portion of the absorption tower.

4. The exhaust gas treatment system according to claim 1, wherein
the absorption tower further includes an absorbing liquid cooling line for cooling the amine-based absorbing liquid extracted from an intermediate portion in the absorption tower and supplying the cooled amine-based absorbing liquid into the absorption tower, and
the state detection unit detects a state of the amine-based absorbing liquid circulating through the absorbing liquid cooling line.

5. The exhaust gas treatment system according to claim 4, wherein
the state detection unit detects a state of the amine-based absorbing liquid at a bottom portion in the absorption tower, and
the control apparatus adjusts the amount of addition of the additive based on difference between the state of the amine-based absorbing liquid circulating through the absorbing liquid cooling line and the state of the amine-based absorbing liquid at the bottom portion of the absorption tower.

6. The exhaust gas treatment system according to claim 1, wherein the state detection unit detects an oxidation-reduction potential of the amine-based absorbing liquid.

7. The exhaust gas treatment system according to claim 6, wherein the control apparatus reduces the amount of addition of the additive when the detected oxidation-reduction potential of the amine-based absorbing liquid is greater than or equal to a preset upper limit threshold value.

8. The exhaust gas treatment system according to claim 1, wherein the state detection unit detects a dissolved oxygen concentration of the amine-based absorbing liquid.

9. The exhaust gas treatment system according to claim 1, wherein the additive contains at least one selected from the group of sodium hydroxide, potassium hydroxide, calcium hydroxide, sodium carbonate, potassium carbonate, calcium carbonate, and magnesium hydroxide.

10. An absorbing liquid management apparatus provided in an exhaust gas treatment system including a cooling tower configured to cool exhaust gas by bringing the exhaust gas containing carbon dioxide into contact with a cooling liquid, an absorption tower in which an amine-based absorbing liquid capable of absorbing the carbon dioxide in the exhaust gas is introduced and the carbon dioxide in the exhaust gas passing through the cooling tower is absorbed by the amine-based absorbing liquid, and a regeneration tower configured to heat the amine-based absorbing liquid absorbing the carbon dioxide, separate the carbon dioxide from the amine-based absorbing liquid, and regenerate the amine-based absorbing liquid, the absorbing liquid management apparatus comprising:
an addition unit configured to add an additive for adjusting a hydroxide ion concentration of the cooling liquid to the cooling liquid;
a state detection unit configured to detect a state of the amine-based absorbing liquid; and
a control apparatus configured to adjust an amount of addition of the additive in the addition unit based on a state of the amine-based absorbing liquid detected by the state detection unit.

11. An exhaust gas treatment method of cooling exhaust gas by bringing the exhaust gas containing carbon dioxide into contact with a cooling liquid, causing the carbon dioxide in the exhaust gas to be absorbed by an amine-based absorbing liquid capable of absorbing the carbon dioxide in the exhaust gas, heating the amine-based absorbing liquid absorbing the carbon dioxide, separating the carbon dioxide from the amine-based absorbing liquid, and regenerating the amine-based absorbing liquid, the exhaust gas treatment method comprising steps of: detecting a state of the amine-based absorbing liquid; and adjusting an amount of addition of an additive for adjusting a hydroxide ion concentration of the cooling liquid for the cooling liquid based on the detected state of the amine-based absorbing liquid.

12. The exhaust gas treatment method according to claim 11, wherein the step of detecting the state of the amine-based absorbing liquid includes further detecting the hydrogen ion exponent of the cooling liquid, and the step of adjusting the amount of addition includes adjusting the amount of addition of the additive so that the detected hydrogen ion exponent of the cooling liquid is in a preset pH range.

13. The exhaust gas treatment method according to claim 11, wherein the step of detecting the state of the amine-based absorbing liquid includes detecting an oxidation-reduction potential of the amine-based absorbing liquid, and the step of adjusting the amount of addition includes reducing the amount of addition of the additive when the detected oxidation-reduction potential of the amine-based absorbing liquid is greater than or equal to a preset upper limit threshold value.

* * * * *